United States Patent [19]

Eastling

[11] 3,976,026

[45] Aug. 24, 1976

[54] SLOW SPEED STEERING CONTROL FOR JET-POWERED WATER CRAFT

[76] Inventor: George E. Eastling, 258 - 4th Ave. SE., Osseo, Minn. 55369

[22] Filed: Mar. 24, 1975

[21] Appl. No.: 561,082

[52] U.S. Cl. ..... 115/12 R; 114/165

[51] Int. Cl.[2] ..... B63H 11/10

[58] Field of Search ..... 114/162, 164, 165; 115/12 R, 11, 12 A

[56] References Cited

UNITED STATES PATENTS

| | | | |
|---|---|---|---|
| 3,250,072 | 5/1966 | Smith | 115/12 R |
| 3,422,788 | 1/1969 | Horan, Jr. | 115/12 R |
| 3,478,712 | 11/1969 | Fox | 115/12 R |
| 3,613,630 | 10/1971 | Jacuzzi | 115/12 R |

*Primary Examiner*—Trygve M. Blix
*Assistant Examiner*—Stuart M. Goldstein
*Attorney, Agent, or Firm*—James R. Haller; H. Dale Palmatier

[57] ABSTRACT

The jet power unit of a water craft is provided with a steering plate which is deflectable upwardly but which is continuously oriented in the direction of but spaced below the flow of water from the jet. The jet power unit preferably includes movable steering deflectors at its exhaust port which steer the craft by deflecting the jet flow to one side or the other, the steering plate including linkage means for pivoting the plate relative to the craft in response to movement of the jet deflectors to maintain the plane of the steering plate parallel to the direction of jet flow.

11 Claims, 7 Drawing Figures

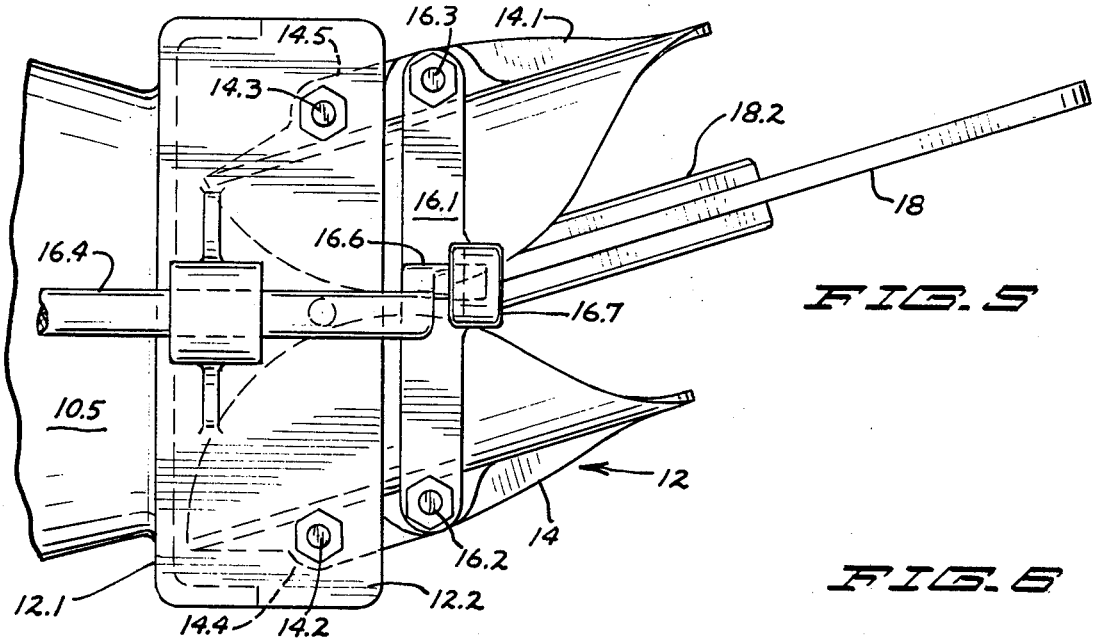
FIG. 5
FIG. 6
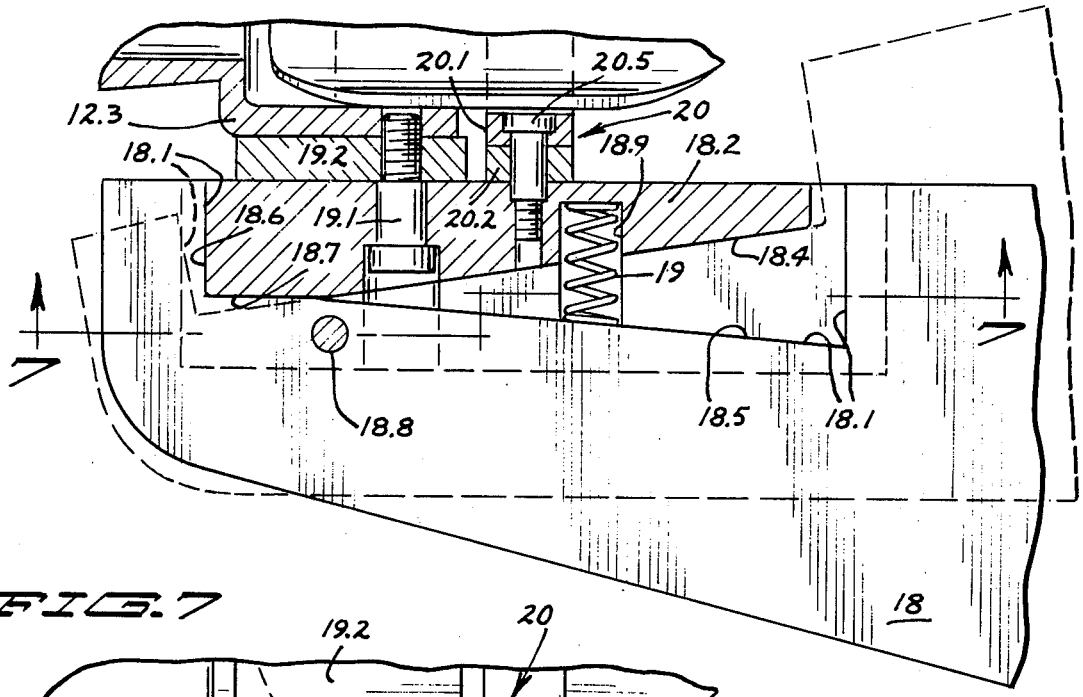
FIG. 7
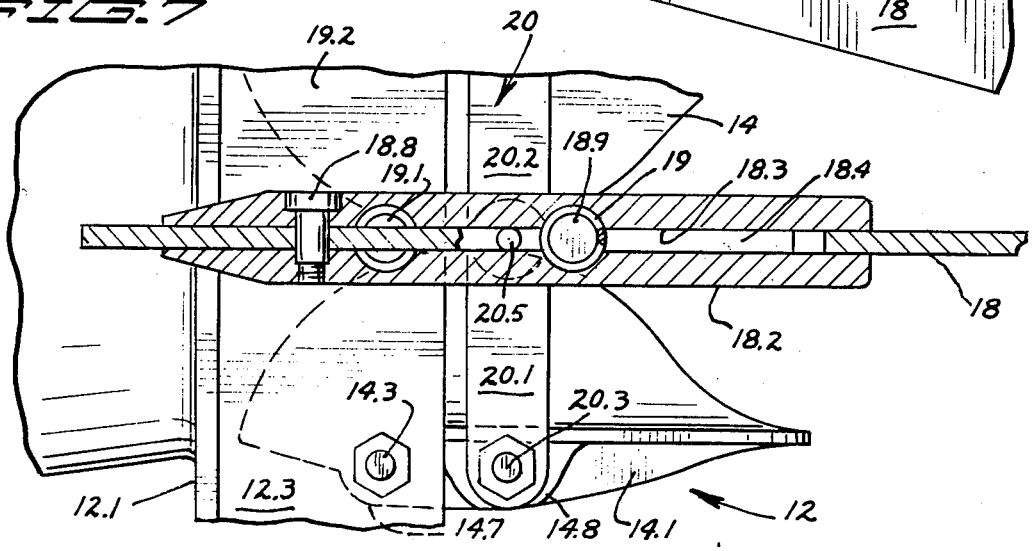

SLOW SPEED STEERING CONTROL FOR JET-POWERED WATER CRAFT

BACKGROUND OF THE INVENTION

In recent years, marine jet propulsion units have become popular for recreational water craft. Such units ordinarily have one or more propellers which are driven within a tubular housing, water being drawn into the housing from one end and being forcefully expelled at the other end to provide a driving force for the craft. In certain of these power units, the tubular housing itself can be pivoted to one side or the other of the craft to provide steering; in other units, deflector plates are provided at the exhaust end to deflect the jet flow to one side or the other of the craft.

At cruising speeds, craft equipped with such jet units are readily steered and are easily maneuvered. I have found, however, that steering is very difficult for such craft at slow speeds, as when such craft are brought slowly to a mooring, or during trolling for fish. At very slow speeds, such craft are only very slightly responsive to changes in the direction of jet flow, presumably at least in part because of the swirling motion imparted to the jet flow by the propellers.

A device which would permit a jet-propelled water craft to be steered easily at slow speeds is much to be desired.

BRIEF SUMMARY OF THE INVENTION

The present invention provides a device for enabling a jet-powered water craft to be steered at slow speeds. The invention relates to an improvement in water craft having a jet power unit in which steering at high speeds is controlled by orienting the jet flow from the unit to one side or the other of the craft. The slow speed steering control comprises a spring-loaded, rudder-like steering plate which is deflectable upwardly against spring pressure, as when a rock or other obstacle is encountered by the craft. Means are provided to mount the steering plate in a generally vertical plane to the water craft, the mounting means including means continuously maintaining the plane of the steering plate parallel to but spaced below the jet flow. In a preferred embodiment, the jet unit includes a housing which provides a jet exhaust port with jet deflectors which are movable to deflect the jet flow to one side or the other for steering, and the mounting means includes means pivotally mounting the steering plate adjacent its leading end to the housing and linkage means which connect at least one of the jet flow deflectors to the steering plate at a point spaced forwardly of the pivotal mounting of the plate to the housing, the linkage means causing the steering plate to pivot to one side or the other in response to steering movement of the deflectors to maintain parallel alignment between the steering plate and the jet flow.

DESCRIPTION OF THE DRAWING

FIG. 5 is a top view similar to that of FIG. 4 showing the relationship of various parts as a water craft undergoes a turning movement;

FIG. 6 is a broken away, cross-sectional view taken along line 6—6 of FIG. 3; and FIG. 7 is a bottom view, partially broken away, and taken along line 7—7 of FIG. 6.

DETAILED DESCRIPTION OF THE PREFERRED EMBODIMENT

Figure 1:
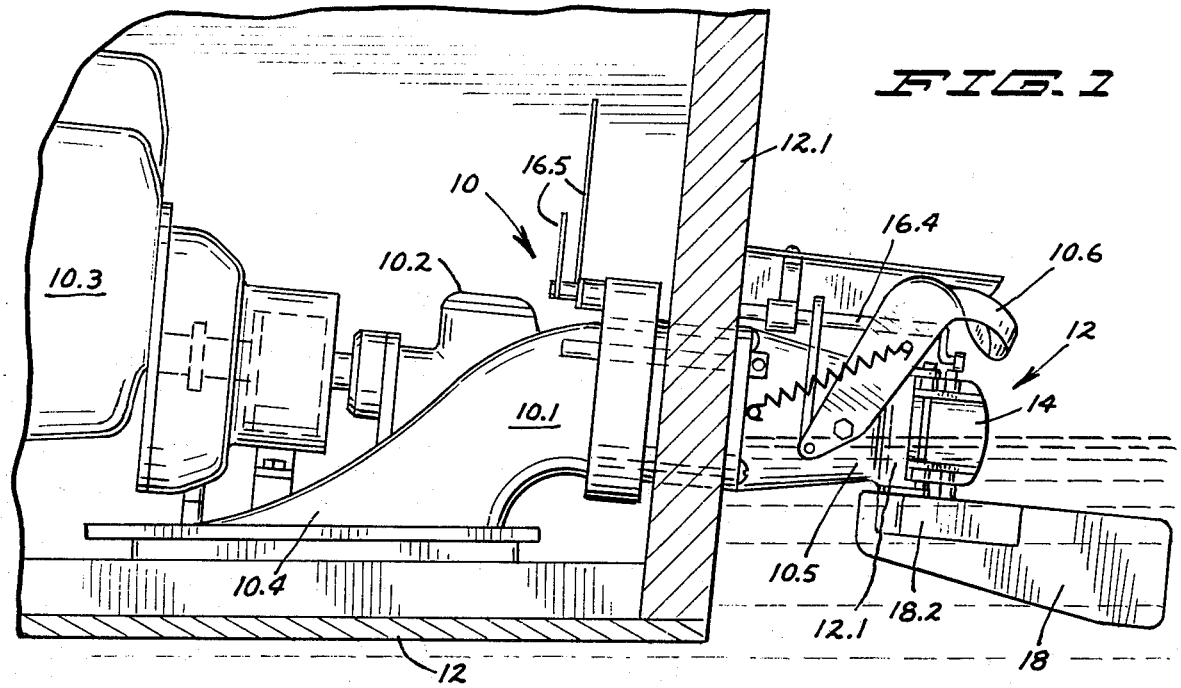
FIG. 1 is a partial elevational view of a marine jet unit equipped with the device of the invention.

Referring first to FIG. 1, a marine jet propulsion unit 10 is shown, this unit being of the type known as the 750 series and manufactured by C. W. F. Hamilton & Co. Ltd., Jet Propulsion Division, Christchurch, New Zealand. The unit includes a tubular housing 10.1 within which are housed a series of propellers driven through gear box 10.2 from an internal combustion engine 10.3. The housing 10.1 includes a forward, flared section 10.4 through which water enters from beneath the craft 12, and an exhaust port 10.5 through which a jet flow of water, propelled by the propellers within the housing, is discharged with great force. A "reversing bucket" 10.6, of a type known to the art, is pivotally mounted to the housing 10.1 to reverse the direction of jet thrust when the bucket is brought into alignment with the jet flow.

Figure 2:
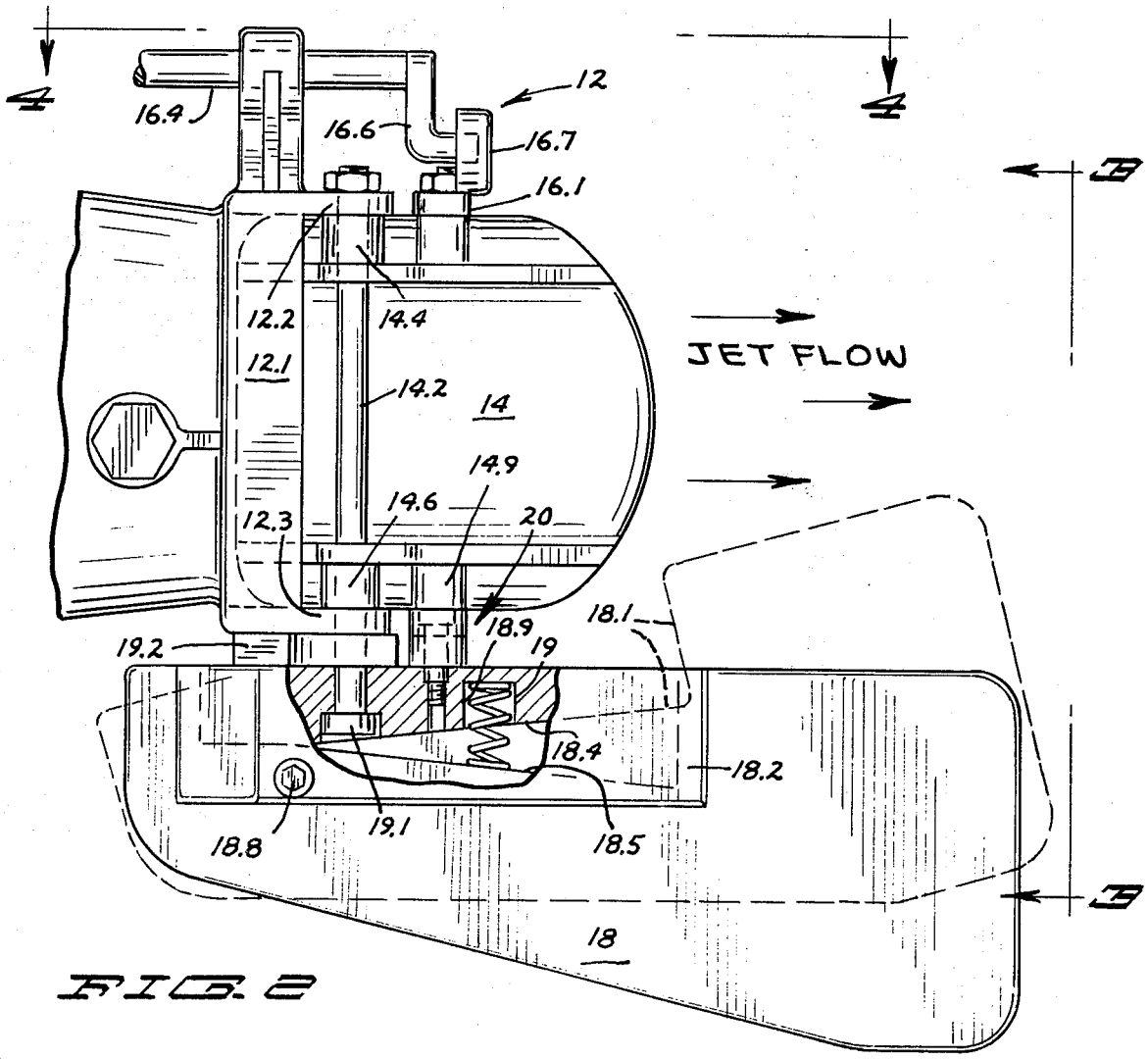
FIG. 2 is a broken away, enlarged side view of the exhaust end of the power unit of FIG. 1, shown partially in cross section.
Figure 3:
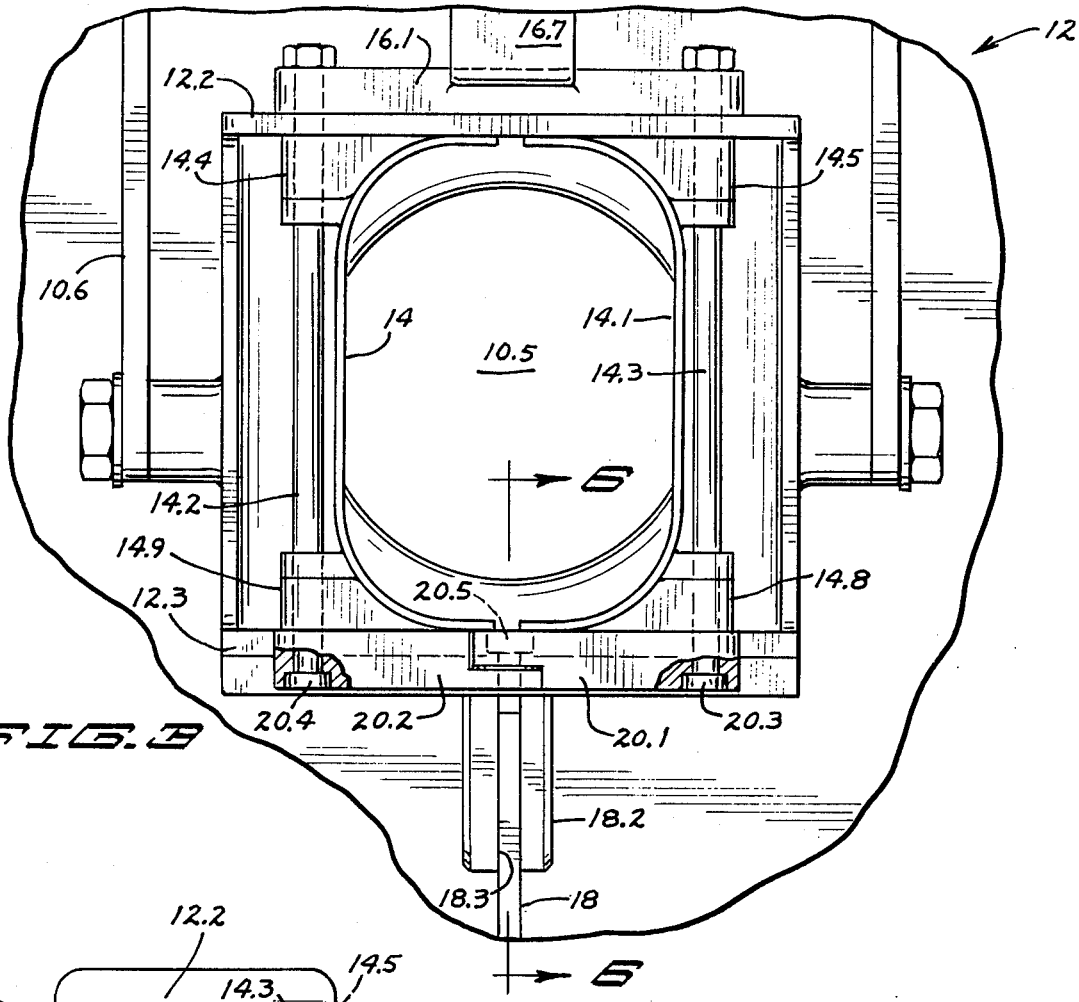
FIG. 3 is a broken away view taken along line 3—3 of FIG. 2.

Referring now particularly to FIGS. 1, 2 and 3, a steering mechanism designated generally as 12 is provided to deflect the jet flow discharged from the exhaust port 10.5 toward one side or the other of the craft to steer the craft. The deflection mechanism includes a frame 12.1 mounted to the jet unit housing 10.1, the frame having upper and lower arms 12.2, 12.3 extending rearwardly beyond the exhaust pot 10.5 of the power unit housing. A pair of concave, inwardly facing deflectors 14, 14.1 are pivotally mounted by means of upright pivot pins 14.2, 14.3 which pass through upper and lower lugs 14.4, 14.5 and 14.6, 14.7 on the rear outer surfaces of the deflectors and which pass through the upper and lower arms 12.2, 12.3 of the frame 12.1. The pivot pins 14.2, 14.3 lie in a plane which is substantially perpendicular to the direction of jet flow discharged from the exhaust port 10.5 of the jet unit housing.

Figure 4:
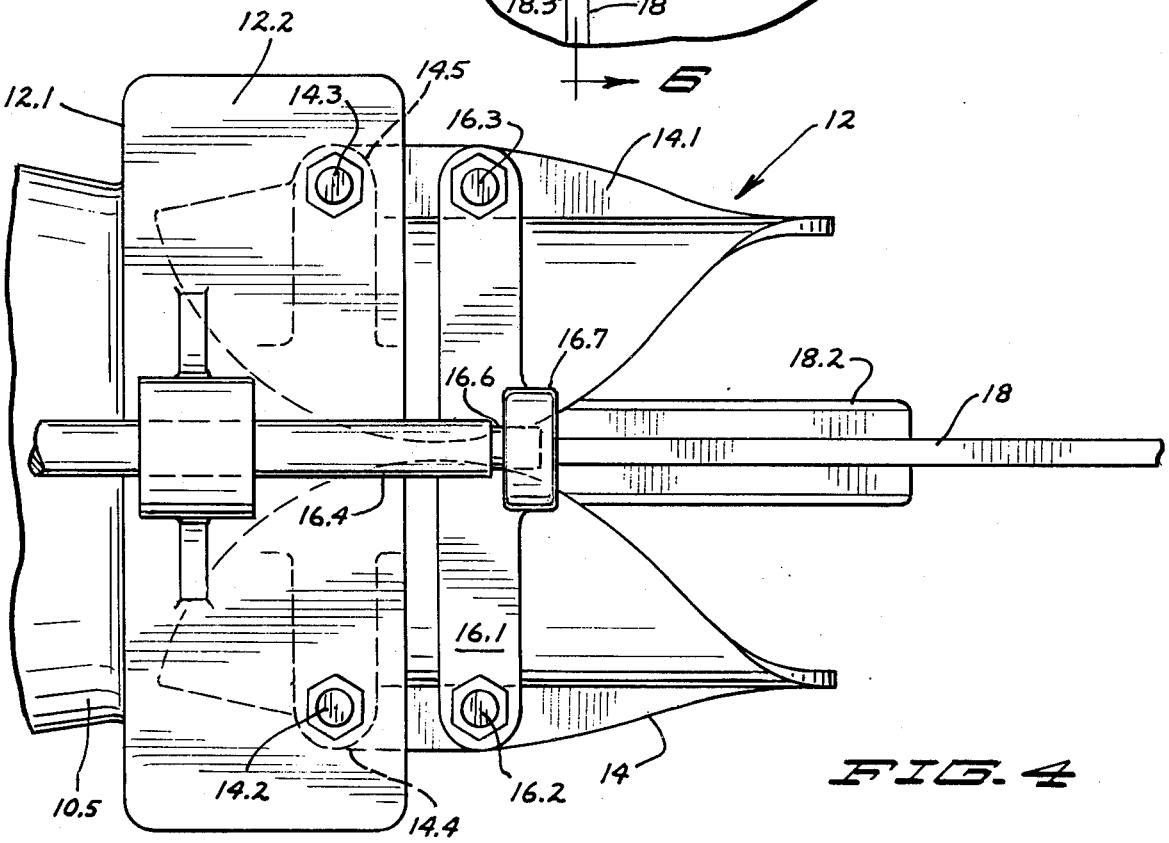
FIG. 4 is a top view taken along line 4—4 of FIG. 2.

A steering bar 16.1 extends across the top of the deflectors 14, 14.1 and is pivotally attached at its ends by means of pins 16.2, 16.3 to the respective deflector plates 14, 14.1 at points spaced rearwardly from the pivot pins 14.2, 14.3, as shown best in FIGS. 2 and 4. The distance separating the pivot pins 14.2 and 14.3 is the same as that separating the pivot pins 16.2, 16.3, and the distance separating the pivot pins 14.2, 16.2, is identical to that separating pivot pins 14.3 and 16.3.

A steering rod 16.4 extends forwardly through the transom 12.1 of the craft and is pivoted about its axis by means of cables designated generally 16.5 (FIG. 1) which in turn are operated by a steering wheel or the like mounted near the front of the craft, in the usual fashion. Depending from the rear end of the steering rod is an L-shaped steering crank 16.6 (best shown in FIG. 2). A rearwardly extending, offset portion of the steering crank 16.6 is pivotally received within a projection 16.7 mounted to the upper surface of the steering bar 16.1, such that rotation of the steering rod 16.4 about its axis causes the steering bar 16.1 to move from side to side, transversely of the direction of jet flow through the exhaust port 10.5. With reference to FIG. 4, it will be understood that as the steering bar 16.1 moves transversely from side to side, the deflector plates 14, 14.1 will be pivoted concurrently about the pivot pins 14.2, 14.3, thereby deflecting the jet flow from the exhaust port 10.5 slightly toward one side of the craft or the other. The parallel linkage provided by the pivot pins 14.2, 14.3 and 16.2, 16.3 assures that the inner, concave surfaces of the deflector plates will remain parallel to one another.

Mounted to the frame arm 12.3, and spaced beneath the jet flow between the deflector plates 14, 14.1, is an elongated steering plate 18. The plane of the steering plate is generally vertical, with the upper surface of the plate being generally aligned with the direction of jet flow through the deflectors and the lower edge of the plate slanting downwardly toward the rear, the surface area of the plate increasing rearwardly, as shown best in FIG. 2. In its upper surface, the plate 18 is provided intermediate its length with a U-shaped cut out portion designated 18.1 in FIGS. 2 and 6. An elongated, generally rectangular mounting plate 18.2 mounts the steering plate 18 to the frame arm 12.3. The mounting plate is provided with a slot 18.3 in its lower edge (FIG. 7), the slot terminating upwardly in an upwardly and rearwardly slanting surface 18.4 against which the upper surface 18.5 of the U-shaped cut out portion of the steering blade may seat. The front and rear edges of the mounting plate are similarly slotted to receive the steering plate 18, as best shown in FIGS. 2 and 6. The inner, forward facing and downward facing surfaces of the slot in the mounting plate (FIG. 6) abut and lie against the cooperating surfaces in the U-shaped cut out portion of the steering plate when the upper edge of the latter plate is parallel to the direction of jet flow. It will further be noted that the inner slot surfaces 18.6 and 18.7 of the mounting plate are substantially perpendicular to one another, and that the surface 18.7 is at a slight angle (about 10°–12°) to the surface of the slot edge 18.4 rearwardly on the mounting plate.

The steering plate 18 is pivotally connected to the mounting plate by means of a transverse pivot pin 18.8 which passes through the steering and mounting plates at a position adjacent the bottom edge but spaced slightly from the leading edge of the mounting plate, as shown best in FIGS. 2 and 7. The position of the pivot pin enables the slot surfaces 18.6 and 18.7 of the mounting plate to engage the corresponding surfaces of the steering plate when the latter is in its normal position (shown in solid lines in FIG. 6) but enables the steering plate to pivot so that the surface 18.5 of the cut out portion comes into contact with the corresponding upwardly slanting slot surface 18.4 of the mounting plate when the steering plate has been urged upwardly, as by striking a submerged log or the like in the water. A cylindrical spring seat 18.9 is formed from beneath into the mounting plate forwardly of the pivot pin 18.8, and a helical spring 19 is received within the spring seat with its lower end abutting the upper edge 18.5 of the cut out portion of the steering plate, the spring being supported throughout its length by the mounting plate to prevent the spring from escaping. The spring continuously urges the steering plate into its normal running position shown in solid lines in FIGS. 2 and 6.

The mounting plate 18.2 is pivotally mounted to the frame arm 12.3 by an upright pivot pin 19.1, the pivot pin passing upwardly through a spacer block 19.2 and being screwed into the frame arm 12.3, as shown best in FIG. 6. The pivot pin 19.1 is spaced between, and is positioned directly in line with the pivot pins 14.2 and 14.3 so that the pivotal axes defined by the three in-line pins lie in a single plane which is perpendicular to the axis of jet flow through the exhaust port 10.5.

A steering arm 20, which may consist of links 20.1 and 20.2, is pivotally connected at its ends to lugs 14.8, 14.9 by means of pivot pins 20.3, 20.4, as shown best in FIGS. 3 and 7, the latter pivot pins being beneath and directly in line with the pivot pins 16.2 and 16.3 mounted to the upper portions of the deflector plates. The links 20.1, 20.2 have mating, offset ends as shown in FIG. 3, and a pivot pin 20.5 passes downwardly through these ends to pivotally mount the same to the mounting plate 18.2 at a position spaced forwardly of the pivot pin 19.1. The distance separating the axes of the pivot pins 19.1 and 20.5 is the same as that separating the pins 14.3 and 20.3. The links 20, 20.1 may, if desired, be replaced with a single bar, and it may also be desirable to move the position of the pivot pin 20.5 nearer to or further away from the pivot pin 19.1 for reasons which will subsequently be explained.

In operation, the steering plate 18 has a stabilizing effect upon the craft during high speed operation. At slow speeds, however, as when a mooring is being approached, the steering plate 18 assumes greater importance in steering the craft. As the steering wheel or the like is turned, the deflector plates 14, 14.1 are pivoted through the parallel linkages described above toward one side of the boat or the other. The movement of the deflector plates acts through the pivot pin 20.5 to cause the steering plate to similarly pivot about the axis of the pivot pin 19.1. The equal distances separating the pairs of pivot pins 14.3, 16.3; 14.2, 16.2 and 19.1, 20.5 insure that the steering plate 18 will be maintained parallel to the deflector plates 14, 14.1 and hence to the jet flow through the deflector plates. The steering plate and its mounting plate 18.2 are positioned beneath the jet flow, as shown best in FIG. 2, so that the reversing bucket 10.6 may be swung down in alignment with the jet flow when needed.

If desired, the pivot pin 20.5 may be moved forwardly closer to the pivot pin 19.1. In this event, the steering plate 18 will describe a greater arc than that described by the deflector plates when the latter are pivoted toward one side or the other of the craft. This feature enhances the slow-speed turning capacity of the craft. It will be understood that movement of the pivot pin 20.5 further to the rear of the pivot pin 19.1 will have the opposite effect. Adjustment of the position of the pivot pin 20.5 in this manner thus enables the maneuvering and steerability of the craft to be optimally adjusted.

Although described above with reference to a jet unit having deflector plates, it is contemplated that the steering device of the invention will be useful as well with jet units in which the housing 10.5 is caused to turn to the left or to the right to steer a water craft. Although it is desired that the steering plate be maintained in parallel alignment with the direction of jet flow, suitable linkage elements of the type described may be provided to cause the steering plate to move through a greater or lesser arc than the arc described by the jet flow during a turning maneuver.

Thus, I have provided a slow speed steering control for a jet-powered water craft in which the steering control includes a steering blade which is movable with respect to the craft in unison with movement of the jet flow steering mechanism of the craft, and which preferably is maintained in parallel alignment with the direction of jet flow. The steering plate is positioned below the jet flow emanating from the jet power unit, and consists of few parts which are easily installed on existing jet power units. By virtue of my invention, jet-powered water craft can be controlled easily at slow speeds, as when a mooring is approached or while fishing.

While I have described a preferred embodiment of the present invention, it should be understood that various changes, adaptations, and modifications may be made therein without departing from the spirit of the invention and the scope of the appended claims.

What is claimed is:

1. In a water craft having a jet power unit with a steering control orienting the direction of jet flow from the unit toward one side or the other of the craft to steer the craft, a slow-speed steering device comprising a steering plate; a mounting plate mounting the steering plate to the power unit with the steering plate in a substantially vertical plane; means moving the steering plate in unison with movement of the steering control to maintain the steering plate substantially parallel to the jet flow from the jet power unit; the mounting plate and steering plate having pairs of cooperating surfaces permitting the steering plate to be deflected upwardly from a normal running position when an obstruction or the like is encountered, one pair of cooperating surfaces being engageable to limit the upward deflection movement of the steering plate and the other pair of surfaces being engageable to define the normal, running position of the steering plate, the mounting plate including a spring urging the steering plate into its normal position.

2. The device of claim 1 in which the jet power unit includes a housing with a jet exhaust port, and movable jet deflectors on either side of the port for directing the jet flow toward one side or the other of the craft; and wherein the mounting means includes an upright pivot pin mounting the steering plate adjacent its leading edge to the housing, and linkage means attached to the steering plate rearwardly of the pivot pin for pivoting the steering plate about the pivot pin in response to movement of the jet deflectors.

3. The device of claim 1 wherein the mounting plate is pivotally mounted adjacent its leading edge to the steering plate to permit the steering plate to pivot about a generally horizontal axis, and the mounting plate being pivotally attached to the jet power unit to permit the mounting and steering plates to pivot together about a generally upright axis.

4. The device of claim 1 wherein said mounting plate includes a slot therein receiving the steering plate, said cooperating surfaces being formed in the slot and on the edge of the steering plate, respectively.

5. The device of claim 4 including a spring seat formed in the mounting plate for seating and supporting the spring in position to urge separation of the one pair of cooperating surfaces.

6. The device of claim 1 including an upright pivot pin mounting the mounting plate to the power unit housing and permitting the mounting plate and steering plate to pivot together about an axis substantially normal to the direction of jet flow.

7. In a water craft having a jet power unit with a steering control orienting the direction of jet flow from the unit toward one side or the other of the craft to steer the craft, a slow-speed steering device comprising a steering plate; a mounting plate pivotally mounted adjacent its leading edge to the steering plate and including an upright pivot pin mounting the mounting plate to the power unit and permitting the mounting plate and steering plate to pivot together about an axis substantially normal to the direction of jet flow, the mounting plate and steering plate having pairs of cooperating surfaces of which one pair of surfaces is oriented to limit the upward deflection movement of the steering plate and the other pair of surfaces is oriented to define the normal, running position of the steering plate, the mounting plate including a spring urging the steering plate into its normal, running position and the cooperating surfaces permitting the steering plate to be deflected upwardly from a normal running position when an obstruction or the like is encountered; the jet power unit including a housing with a jet exhaust port having movable jet deflectors for directing the jet flow toward one side of the craft or the other to steer the craft; and linkage means mechanically linking the deflectors to the mounting plate to move the latter toward one side of the craft or the other in response to movement in the same direction of the deflectors.

8. The device of claim 7 wherein the linkage means is attached to the mounting plate rearwardly of said pivot pin a sufficient distance so that the angle traversed by the steering plate in response to movement of the deflectors is less than that traversed by the deflectors during said movement.

9. The device of claim 7 wherein the linkage means is attached to the mounting plate rearwardly of said pivot pin a sufficient distance so that the angle traversed by the steering plate in response to movement of the deflectors is greater than that traversed by the deflectors during said movement.

10. In a water craft having a jet power unit including a housing with a jet exhaust port having movable jet deflectors on either side thereof for directing the jet flow toward one side of the craft or the other to steer the craft, a slow-speed steering device comprising a. a generally flat, elongated steering plate;

b. a mounting plate having a slot therein receiving the steering plate with the steering plate being pivotally mounted to the mounting plate adjacent the leading edge of the latter, the slot in the mounting plate and the steering plate having pairs of cooperating surfaces, one pair of surfaces being engageable to limit the upward, deflection movement of the steering plate and the other pair of surfaces being engageable to define the normal, running position of the steering plate, the mounting plate including a spring seat and helical spring positioned to urge separation of the one pair of cooperating surfaces, the mounting plate including a generally upright pivot pin pivotally mounting the mounting plate to the jet unit housing with the steering plate being carried below the jet flow;

c. a linkage pivotally mounted at its ends to the respective deflectors and pivotally mounted at a point along its length to the mounting plate to cause the steering plate to moe in unison with and in the same direction as the deflectors with the steering plate maintained generally parallel to the direction of jet flow through the deflectors.

11. The device of claim 10 wherein the pivotal mounting of the linkage to the mounting plate is adjustable along the length of the mounting plate to change the angle traversed by the steering plate in response to movement of the deflectors through a given angle.

* * * * *